US009212027B1

(12) United States Patent
Chase et al.

(10) Patent No.: US 9,212,027 B1
(45) Date of Patent: Dec. 15, 2015

(54) GATE SYSTEM FOR RESIDENTIAL ELEVATORS

(71) Applicant: A+ Elevators & Lifts LLC, Salt Lake City, UT (US)

(72) Inventors: Kevin M. Chase, Cottonwood Heights, UT (US); Christopher R. Harris, Woods Cross, UT (US); Matthew P. Hyde, Farmington, UT (US)

(73) Assignee: A+ Elevators & Lifts LLC, Salt Lake City, UT (US)

( * ) Notice: Subject to any disclaimer, the term of this patent is extended or adjusted under 35 U.S.C. 154(b) by 561 days.

(21) Appl. No.: 13/630,693

(22) Filed: Sep. 28, 2012

Related U.S. Application Data

(60) Provisional application No. 61/540,389, filed on Sep. 28, 2011.

(51) Int. Cl.

| | |
|---|---|
| ***B66B 13/30*** | (2006.01) |
| ***B66B 13/08*** | (2006.01) |
| ***E05D 15/06*** | (2006.01) |
| *E05D 15/12* | (2006.01) |

(52) U.S. Cl.
CPC ..... *B66B 13/08* (2013.01); *E05D 15/063* (2013.01); *B66B 13/30* (2013.01)

(58) Field of Classification Search
CPC ..... B66B 13/30; B66B 13/08; B66B 13/305; E05D 15/063
USPC ..... 49/116, 120, 125, 370, 409, 426, 458; 16/94 R; 160/196.1; 187/324, 334
See application file for complete search history.

(56) References Cited

U.S. PATENT DOCUMENTS

| | | | | |
|---|---|---|---|---|
| 649,729 | A | 5/1900 | Isbills | |
| 1,073,509 | A * | 9/1913 | Nelson | 16/106 |
| 1,258,439 | A | 3/1918 | Ogden | |
| 3,098,519 | A * | 7/1963 | Myers et al. | 160/40 |
| 4,014,071 | A | 3/1977 | Janson | |
| 4,102,007 | A | 7/1978 | Janson | |
| 4,102,008 | A | 7/1978 | Janson | |
| 4,285,095 | A | 8/1981 | Janson | |
| 5,036,953 | A * | 8/1991 | Munz | 187/334 |
| 5,109,911 | A | 5/1992 | Bockisch | |
| 5,143,137 | A * | 9/1992 | West | 160/199 |
| 6,082,499 | A | 7/2000 | O'Donnell | |
| 6,647,590 | B2 * | 11/2003 | Haab et al. | 16/90 |
| 8,240,354 | B2 * | 8/2012 | Coleman et al. | 160/188 |
| 2011/0061819 | A1 * | 3/2011 | Elinson | 160/196.1 |

FOREIGN PATENT DOCUMENTS

| | | | | |
|---|---|---|---|---|
| JP | 02008186 A * | 1/1990 | | B66B 13/08 |

* cited by examiner

*Primary Examiner* — William A Rivera
*Assistant Examiner* — Stefan Kruer
(74) *Attorney, Agent, or Firm* — Thorpe North & Western, LLP

(57) ABSTRACT

A sliding gate assembly for an elevator comprises a track having a flat upper surface. A connecting block is secured to a portion of the flat upper surface. A wheel carriage is operable to ride on the track, the wheel carriage including two arms oriented orthogonally to the flat upper surface of the track and extending upwardly around an outside portion of the track and beyond the flat upper surface. A set of wheels is also provided, each wheel being rotatably coupled to one of the two arms of the wheel carriage above the upper surface of the track, each wheel rotating about a rolling axis that is substantially parallel to the flat upper surface of the track.

17 Claims, 8 Drawing Sheets

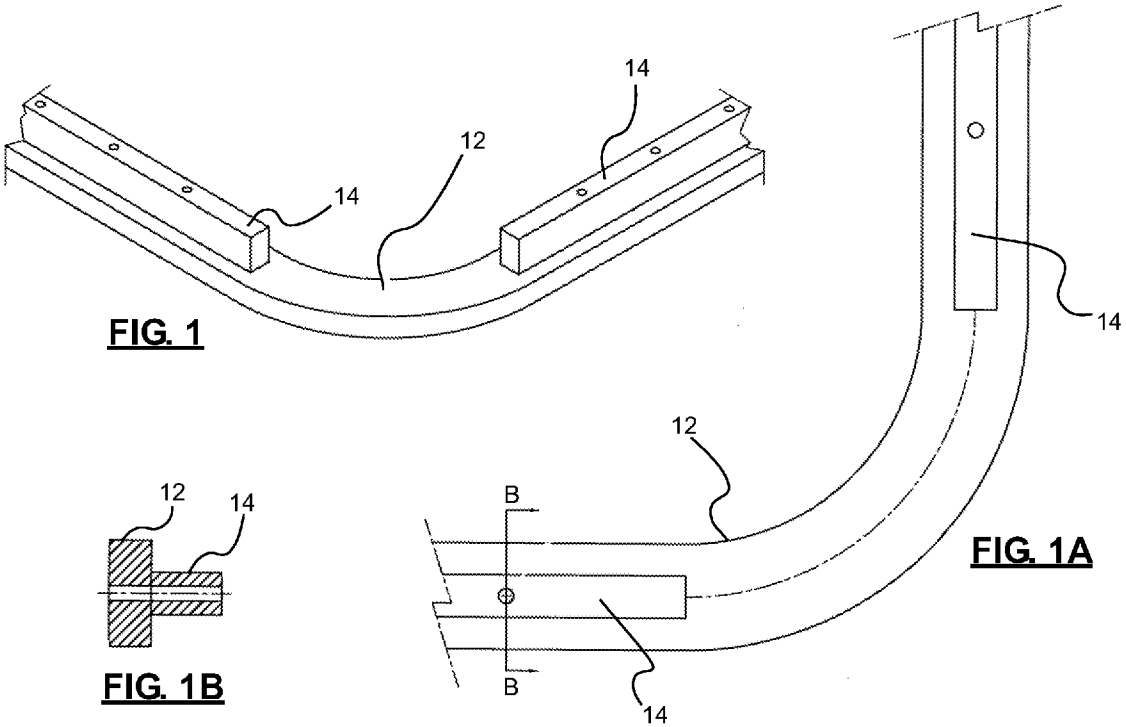
FIG. 1
FIG. 1A
FIG. 1B
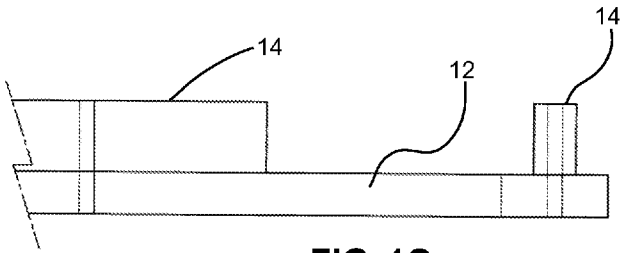
FIG. 1C

GATE SYSTEM FOR RESIDENTIAL ELEVATORS

PRIORITY CLAIM

This application claims benefit and priority of U.S. Provisional Patent Application Ser. No. 61/540,389, filed Sep. 28, 2011, which is hereby incorporated herein by reference in its entirety.

BACKGROUND OF THE INVENTION

1. Field of the Invention

The present invention relates generally to gate systems for use as elevator doors. More particularly, the present invention relates to gate systems for use with elevators installed in residential settings.

2. Related Art

Doors or gates for allowing entrance into, and egress from, elevator cars must be provided as a functional component of all modern elevators. While such door systems have been in use for many years, the efficacy, safety and efficiency of door systems vary widely. Typically, designers of commercial elevator door systems can provide highly safe and effective systems because there typically exists ample space near the elevator stop on each floor to install and operate such doors.

However, designers of residential elevator systems are often presented with much less space into which the door system can be installed and operated. As such, efforts have been made in the past to provide very compact systems that can still be operated safely. Unfortunately, many of these such systems, while being compact, suffer from inefficiencies introduced by the compact design and often don't operate reliably for long periods of time and can be excessively noisy and prone to undesirable wear. Also, some such systems can pose safety hazards for young children, who often do not have sufficient judgment to recognize the dangers associated with mechanical systems.

SUMMARY OF THE INVENTION

In accordance with one embodiment, the invention provides a sliding door assembly for an elevator that includes a track having a flat upper surface. A connecting block can be secured to a portion of the flat upper surface. A wheel carriage can be operable to ride on the track, the wheel carriage including two arms oriented orthogonally to the flat upper surface of the track and extending upwardly around an outside portion of the track and beyond the flat upper surface. A set of wheels can also be provided, each wheel being rotatably coupled to one of the two arms of the wheel carriage above the upper surface of the track, each wheel rotating about a rolling axis that is substantially parallel to the flat upper surface of the track.

In accordance with another aspect of the invention, a sliding gate assembly for an elevator is provided, including a track having a substantially flat upper surface and a connecting block secured to a portion of the flat upper surface. A wheel carriage can be operable to ride on the track. The wheel carriage can include two arms oriented substantially orthogonally to the flat upper surface of the track and can extend upwardly around an outside portion of the track and beyond the flat upper surface. A set of wheels can also be provided, each wheel being rotatably coupled to one of the two arms of the wheel carriage above the upper surface of the track, each wheel rotating about a rolling axis that is substantially parallel to the flat upper surface of the track. A door panel can be coupled to and can extend downwardly from the wheel carriage. Rolling axes of the wheels and the flat upper surface of the track can be substantially parallel and can be oriented substantially orthogonally to the gravity vector.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

FIG. 1 is a perspective view of an exemplary embodiment of a gate track in accordance with an embodiment of the invention;

FIG. 1A is a top view of the gate track of FIG. 1;

FIG. 1B is a sectional view of the gate track of FIG. 1, taken along section B-B of FIG. 1A;

FIG. 1C is a side view of the gate track of FIG. 1;

Figure 2A:
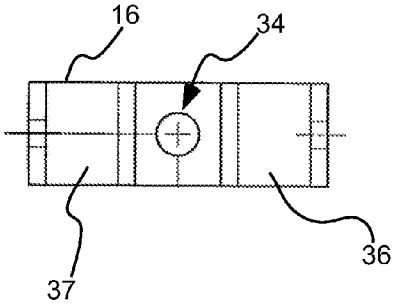
FIG. 2A is a top view of an exemplary embodiment of a wheel carriage in accordance with an embodiment of the invention.

It is to be understood that the figures include, in some cases, only exemplary embodiments of the invention and are not to be considered as limiting the invention in any way. In the case where dimensions are provided in the figures, these dimensions are illustrative only; the actual components of the system can vary from the exemplary dimensions provided. Also, not all components necessary for operation of the elevator gate or door system are shown in figures, it being understood that one of ordinary skill in the art could readily practice the invention if in possession of the present disclosure.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As generally illustrated in the figures, in accordance with one aspect, the invention provides a tambour gate for residential elevators that can be adapted for use with a variety of elevator systems to provide a safe and reliable gate or door system for an elevator. The present invention provides a gate or door system that is considerably safer than those of conventional systems.

Typically, conventional home elevator gate systems are configured as "accordion gate" systems. These systems typically function like an accordion and have gates shaped accordingly. Conventional gates of this type are extremely flexible when pressed upon or leaned against, and thus carry a very high safety risk.

Many residential elevator safety codes specifically address the amount of space between the inside face of a closed hoistway door and the closed gate (or door) on the elevator car. Typically, a conventional accordion gate is used as the door on the elevator car. The accordion gate, when untouched, meets the requirements of most elevator safety codes. However, when pressed upon or leaned against, conventional accordion doors can cause a situation where a small child can be caught between the hoistway door and the elevator car door. Typically, the elevator system has no way of determining whether a child is in this area or not: rather it simply monitors when the two doors are closed, enabling the elevator to enter into normal operation. This can provide a deadly situation for a small child if the elevator were to move when a child is in this area.

In contrast, the present invention provides a child safe tambour gate system that reduces the possible area for a child to enter between two closed doors/gates. In addition, the "off axis" deflection of the instant gate, when pressed on or leaned against, is dramatically reduced in comparison to that of the typical accordion gate. The present invention also provides a gate system that requires or consumes much less space as opposed to conventional accordion gates (which require a pocket in the elevator car to allow for the gate to open into). For example, the panels of an accordion gate are approximately six inches wide and six inches deep. These panels stack into the pocket area when opened, thus reducing the usable area inside of the elevator car.

In contrast, the instant system eliminates the need for this pocket, as the gate panels of the present system wrap around the exterior of the elevator car, allowing for more net usable space inside the elevator car.

As shown generally in FIGS. 1 through 1C, in one exemplary embodiment of the invention, the gate system can include a top gate track 12 that can include, for example, a five-inch radius-90 degree corner. The track can be mounted to the top of the elevator car (via mounting hardware or blocks 14) to allow for gate operation. The top gate track can be manufactured from a substantially rigid material, for example, hybrid PVC (polyvinylchloride) material. The track mounting hardware can include standard fasteners that connect the track to the ceiling of the elevator car (note that the elevator car and/or the ceiling of the car is not illustrated in the figures—one of ordinary skill in the art having possession of this disclosure will readily appreciate the workings of the components of the present system without including all such known components).

While the track configuration can vary, in one embodiment the gate track 12 can be formed of a substantially continuous piece of material and can include a substantially rectangular cross section. The rectangular cross section can extend along a majority of a length of the track, including along the curved corner portions of the track. In one embodiment, an upper surface of the track presents a substantially seamless rolling surface for the wheels (discussed below). This seamless rolling surface can provide for much quieter operation of the door system and can reduce the wear created by normal operation of the door being opened and closed for many cycles.

Figure 2B:
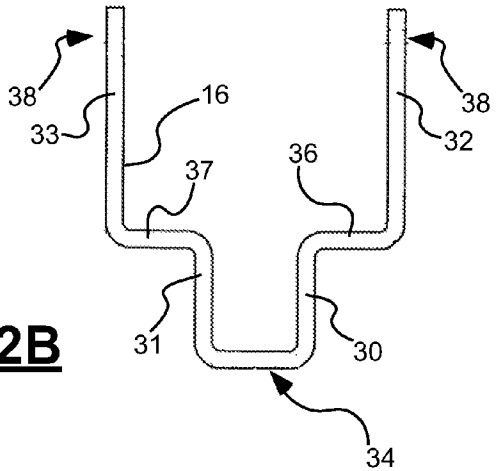
FIG. 2B is a front view of the wheel carriage of FIG. 2A.
Figure 2C:
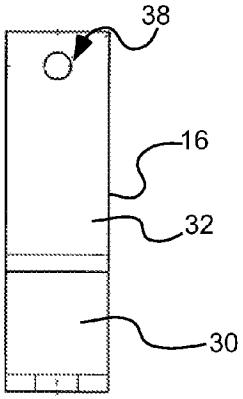
FIG. 2C is a side view of the wheel carriage of FIG. 2A.

As shown in FIGS. 2A through 2C, the system can include a top gate panel roller bracket 16 (also referred to herein as a wheel carriage). In one embodiment, each gate panel 26 can include one wheel carriage of roller bracket. In one example, the wheel carriage can be formed from hard rolled steel, cut, bent and drilled to specifications. The wheel carriage can include a pair of lower arms 30, 31 and a pair of upper arms 32, 33. The lower arms can extend upward from a point 34 where connection to a door panel (discussed below) is made in a substantially parallel relationship. The carriage can include lateral extension sections 36, 37 which extend to the upper arms, which can then extend upwardly in a generally parallel relationship. Rollers or wheels (18 in FIG. 3) can be coupled to the upper arms via ports or holes 38.

Figure 3A:
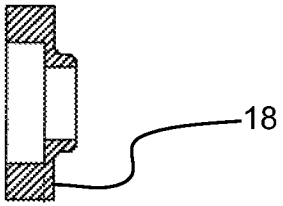
FIG. 3A is a sectional view of the top roller of FIG. 3, taken along section A-A of FIG. 3.
Figure 3:
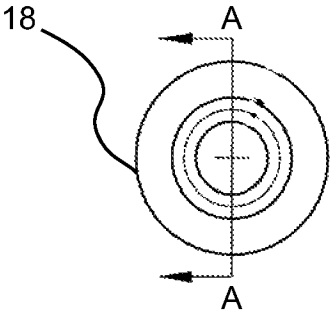
FIG. 3 is a top view of an exemplary embodiment of a top roller or wheel.

As shown in FIG. 3, the system can also include two top roller bracket rollers or wheels 18 that can be coupled to the wheel carriages 16. The wheels can be formed, in one non-limiting example, from clear or colored nylon on the order of about 1.00 inch outside diameter and about 0.375 inches inside diameter. The wheels can include a milled area for roller bearing placement, which can be two "ball" or "pin" bearing style with mounting hardware to properly assemble, as would occur to one of ordinary skill in the art having possession of this disclosure.

Figure 8:
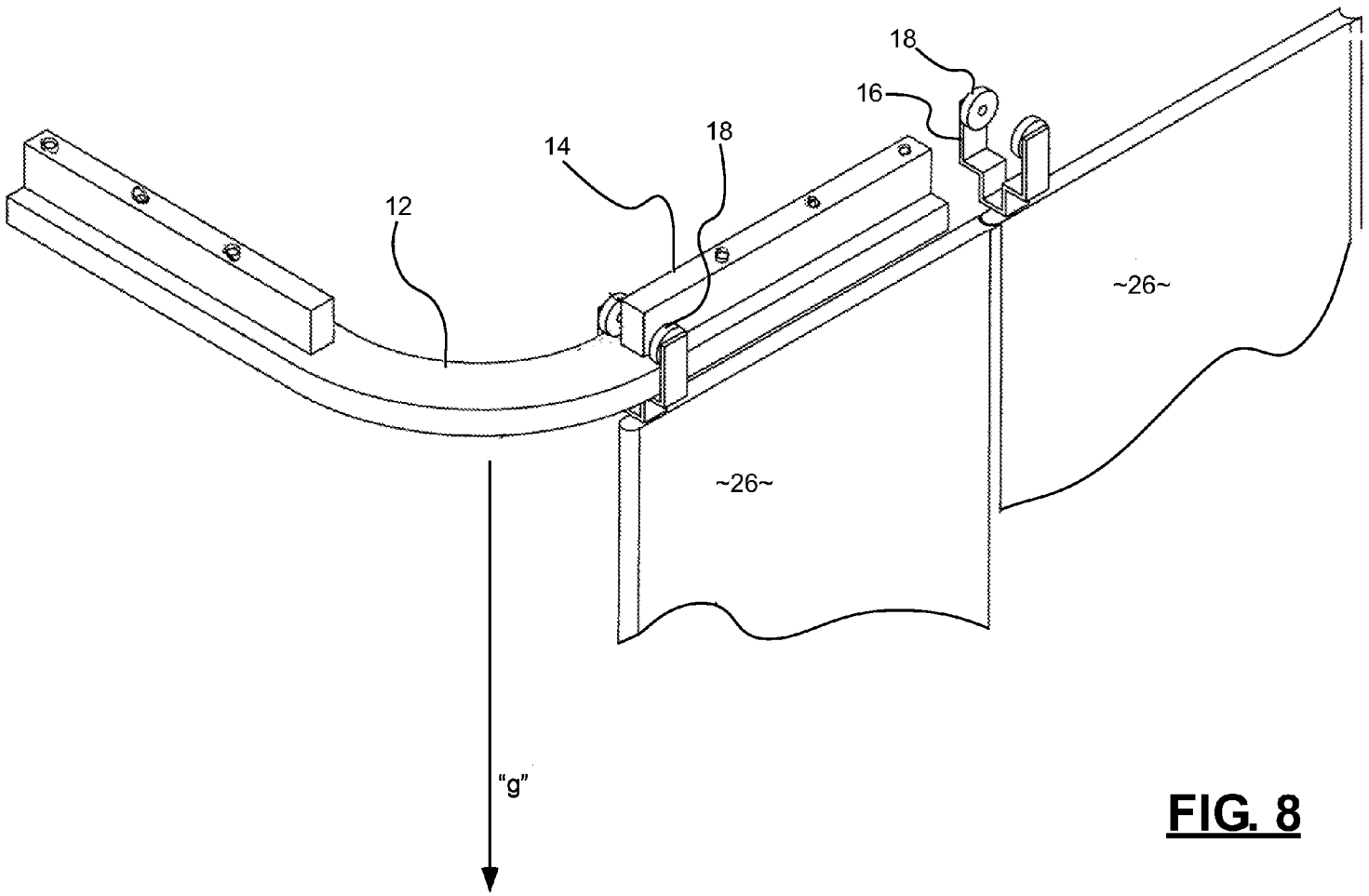
FIG. 8 includes a perspective view of an exemplary elevator gate system in accordance with one embodiment of the invention.

A rolling surface of the wheels 18 are thus oriented substantially parallel to the substantially flat upper or rolling surface of the gate track 12, thus aligning the door "hanging" from the wheel carriages with the gravity vector (shown by example at "g" in FIG. 8). In this manner, the door is free to be easily swung open and closed by a user of the system. In many conventional systems, the orientation of the wheel relative to a track structure is often not aligned with the gravity vector, and the wheels and/or track can bind relative to one another during operation of the gate. The present design provides for very smooth movement of the door or gate panel while providing superior safety to the system overall.

Figure 4:
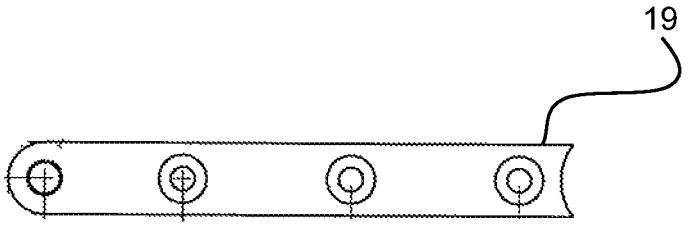
FIG. 4 is a top view of an exemplary embodiment of a gate panel interconnection bracket.
Figure 4A:
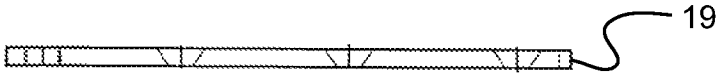
FIG. 4A is a side view of the gate panel interconnection bracket of FIG. 4.

As shown in FIGS. 4 and 4A, the system can also include a gate panel interconnection bracket 19. Each gate panel can include two of these brackets, one positioned at the top and one at the bottom. The interconnection bracket can be manufactured, for example, from hard rolled steel, nickel plated, and can be cut/drilled to specifications.

Figure 5A:
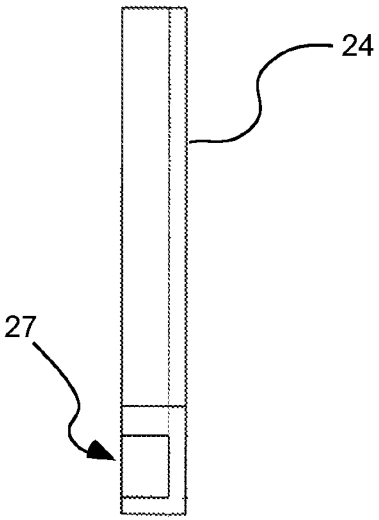
FIG. 5A is a side view of the bottom gate track corner of FIG. 5.
Figure 5:
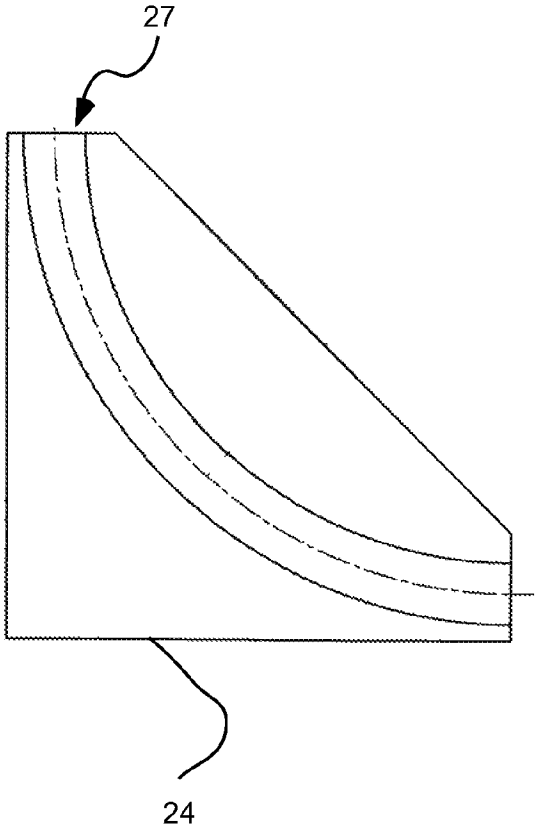
FIG. 5 is a top view of an exemplary embodiment of a bottom gate track corner.
Figure 6:
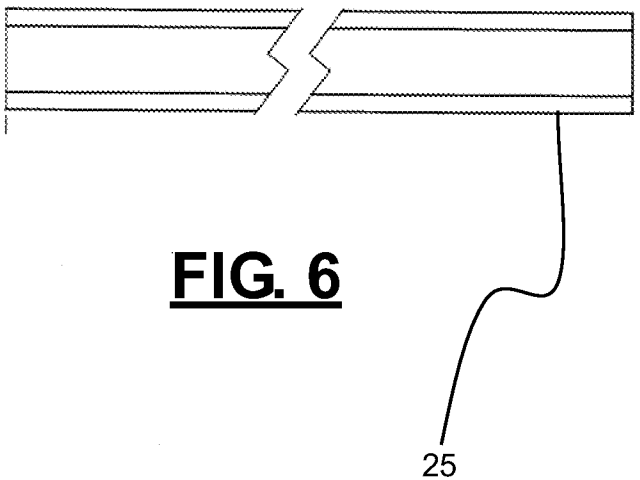
FIG. 6 is a partially sectioned top view of an exemplary embodiment of a bottom gate track.
Figure 6A:
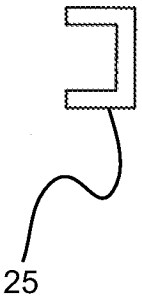
FIG. 6A is an end view of the bottom gate track of FIG. 6.

As shown in FIG. 5, the system can also include a bottom gate track 24 that can be formed of high density polyethylene, and can be formed with a U-shaped channel 27 to receive therein a bottom track guide roller. Straight track sections 25 shown in FIG. 6 can interconnect one or more corner track sections 24 to form a substantially complete lower track (not shown in detail) in which the door or gate panel can be constrained to travel.

Figure 7:
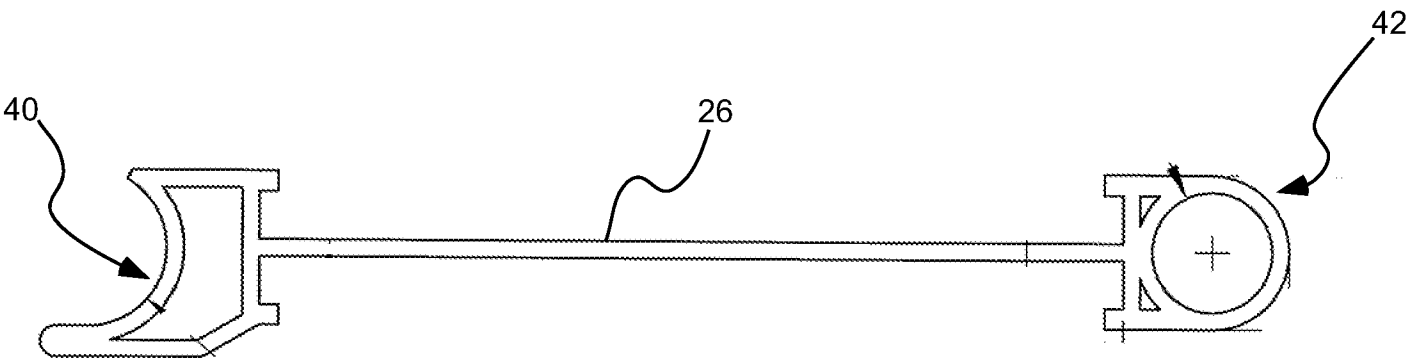
FIG. 7 includes a top view of a "bare" gate panel in accordance with an embodiment of the invention.

As shown in FIG. 7, each gate panel 26 (the number of which can vary depending upon the elevator car being used) can be manufactured from hybrid PVC (polyvinylchloride) material. Each gate panel can be about 6.50 inches in width, and about 1.00 inches in thickness (typically, the length of the gate panel is determined by the height of elevator car). The gate panel can include a decorative or protective covering, such as a wood veneer, tempered glass, wire mesh insert or other custom material for architectural preferences (not shown).

FIG. 8 illustrates the various components of the system assembled into a track system. Two door panels 26 are shown, that can each travel along the track section 12 (yet roll easily past mounting blocks 14) as the door is operated. The sides of the door panels can include alternating "U-shaped" projections and indentations (see, e.g., 40 and 42, respectively, in FIG. 7) to allow successive door panels to nest relative to one another, and thus pivot relative to one another as the door panels are moved around the rounded corner section of the track.

The top roller bracket rollers, bearings, hardware and bottom bracket roller and hardware can be connected to the gate panels using common hardware that can be readily acquired at nominal prices. The top roller bracket assembly can ride on the top gate track. The bottom guide roller can rides in the bottom gate track, allowing the gate to open and close freely. The top roller bracket assembly (or wheel carriage assembly) can allow the rollers to independently operate as it travels along the top gate track, around the 90 degree corner and allow for the gate to smoothly open and close. The top roller bracket assembly can pivot relative to the gate panel bracket to allow for the gate panels to travel around the 90 degree corner.

The bottom guide roller can simply ride in the bottom gate track as a guide for the bottom of the gate panels as it travels around the corner during the opening or closing of the gate. As referenced above, while not so limited, the present system is well suited for use in residential applications. The system serves to protect the elevator passenger(s) as they use the elevator to travel from floor to floor. The gate should be closed prior to the elevator movement and is allowed to be opened when the elevator is at a floor for entering and exiting of passengers. When the gate or door is in the closed orientation, very little off-axis movement of the gate is possible, thus greatly reducing the risk that a small child can be positioned between the gate and a residential structure and become crushed during operation of the elevator.

In some embodiments, optional components can be provided for architectural preference to match the aesthetics of the home or building in which the elevator is installed (e.g., plain gate panel, wood insert, tempered glass insert, wire mesh insert or other custom material). The length (height) of the gate panels can be customized to match the size (height) of the elevator car.

One or both a width between upright arms 32, 33 and/or a width of the gate track 12 can be varied to provide a minimum of clearance between the two to limit lateral movement of the wheel carriage 16 relative to the track. In this manner, lateral or "off-axis" movement of the gate or door can be minimized to prevent binding of the door as it is slid along the path required to open or close.

It is to be understood that the above-referenced arrangements are illustrative of the application for the principles of the present invention. It will be apparent to those of ordinary skill in the art that numerous modifications can be made without departing from the principles and concepts of the invention as set forth in the claims.

What is claimed is:

1. A sliding gate assembly for an elevator, comprising:

a track having a substantially flat upper surface;

a connecting block removably secured to a portion of the flat upper surface, the connecting block being a substantially rigid block of material extending along a portion of the track and being operable to be attached to a ceiling of an elevator cab;

a wheel carriage, operable to ride on the track, the wheel carriage including two arms oriented substantially orthogonally to the flat upper surface of the track and extending upwardly around an outside portion of the track and beyond the flat upper surface;

a set of wheels, each wheel being rotatably coupled to one of the two arms of the wheel carriage above the upper surface of the track, each wheel rotating about a rolling axis that is substantially parallel to the flat upper surface of the track, the wheels being positioned adjacent opposing sides of the connecting block such that the wheel carriage can roll along the flat upper surface of the track without contacting the connecting block.

2. The sliding gate assembly of claim 1, wherein rolling axes of the wheels and the flat upper surface of the track are substantially parallel and are oriented substantially orthogonally to a gravity vector.

3. The sliding gate assembly of claim 2, wherein the rolling axes of the wheels are substantially collinear.

4. The sliding gate assembly of claim 1, wherein the track is curved to wrap around at least a portion of the elevator cab.

5. The sliding gate assembly of claim 4, wherein the upper surface of the track presents a substantially seamless rolling surface to the wheels.

6. The sliding gate assembly of claim 1, wherein the track is formed of a substantially continuous piece of material.

7. The sliding gate assembly of claim 6, wherein each of the track and the connecting block includes a substantially rectangular cross section.

8. The sliding gate assembly of claim 7, wherein the substantially rectangular cross section of the track extends along a majority of a length of the track.

9. The sliding gate assembly of claim 8, wherein the substantially rectangular cross section of the track extends along curved corner portions of the track.

10. The sliding gate assembly of claim 1, further comprising a door or a gate panel coupled to and extending downwardly from the wheel carriage.

11. The sliding gate assembly of claim 1, further comprising a plurality of connecting blocks distributed along a length of the track.

12. A sliding gate assembly for an elevator, comprising:

a track having a substantially flat upper surface;

a connecting block removably secured to a portion of the flat upper surface, the connecting block being a substantially rigid block of material extending along a portion of the track and being operable to be attached to a ceiling of an elevator cab;

a wheel carriage, operable to ride on the track, the wheel carriage including two arms oriented substantially orthogonally to the flat upper surface of the track and extending upwardly around an outside portion of the track and beyond the flat upper surface;

a set of wheels, each wheel being rotatably coupled to one of the two arms of the wheel carriage above the upper surface of the track, each wheel rotating about a rolling axis that is substantially parallel to the flat upper surface of the track, the wheels being positioned adjacent opposing sides of the connecting block such that the wheel carriage can roll along the flat upper surface of the track without contacting the connecting block; and a door panel coupled to and extending downwardly from the wheel carriage; wherein rolling axes of the wheels and the flat upper surface of the track are substantially parallel and are oriented substantially orthogonally to a gravity vector.

13. The sliding gate assembly of claim 12, wherein the substantially rectangular cross section extends along a majority of a length of the track.

14. The sliding gate assembly of claim 13, wherein the substantially rectangular cross section extends along curved corner portions of the track.

15. The sliding gate assembly of claim 12, wherein the track is formed of a substantially continuous piece of material.

16. The sliding gate assembly of claim 12, wherein the track includes a substantially rectangular cross section.

17. The sliding gate assembly of claim 12, further comprising a plurality of connecting blocks distributed along a length of the track, with open spaces defined between adjacent connecting blocks.

* * * * *